US005907938A

United States Patent [19]

Sheahan

[11] Patent Number: 5,907,938

[45] Date of Patent: Jun. 1, 1999

[54] ANTI-BACKOUT ROOF FASTENERS

[76] Inventor: James P. Sheahan, 1001 10½ Mile Rd., Midland, Mich. 48640

[21] Appl. No.: 08/947,292

[22] Filed: Oct. 8, 1997

[51] Int. Cl.[6] ..... E04D 5/14

[52] U.S. Cl. ..... 52/410; 411/531; 411/536

[58] Field of Search ..... 52/410, 408, 703, 52/698; 411/531, 533, 535, 536, 480, 373

[56] References Cited

U.S. PATENT DOCUMENTS

| | | | |
|---|---|---|---|
| 4,723,109 | 2/1988 | Sheahan . | |
| 4,834,600 | 5/1989 | Lemke | 52/410 X |
| 4,860,513 | 8/1989 | Whitman | 52/410 |
| 4,862,664 | 9/1989 | Romine . | |
| 4,881,861 | 11/1989 | Hewison | 52/410 X |
| 4,900,208 | 2/1990 | Kaiser et al. | 52/410 X |
| 5,054,983 | 10/1991 | Froewis et al. | 52/410 X |
| 5,212,927 | 5/1993 | Sheahan | 52/410 X |
| 5,217,339 | 6/1993 | O'Connor et al. | 52/410 X |
| 5,267,423 | 12/1993 | Giannuzzi | 52/410 |
| 5,378,102 | 1/1995 | Mossman | 52/410 X |
| 5,660,015 | 8/1997 | Kluser | 52/410 |
| 5,671,576 | 9/1997 | Kluser | 52/410 X |

*Primary Examiner*—Beth Aubrey
*Attorney, Agent, or Firm*—Robert L. McKellar

[57] ABSTRACT

This invention deals with novel devices which are fasteners for roofing assemblies, especially multi-layered roof assemblies. In addition, there is embodied in this invention a device that is not only a fastener, but is also capable of detecting leaks in roofing systems.

20 Claims, 4 Drawing Sheets

ANTI-BACKOUT ROOF FASTENERS

BACKGROUND OF THE INVENTION

Large industrial and commercial roofs account for a majority of the large roof assemblies in the United States. These roof structures are generally multi-layered, that is, they generally have in combination a roof supporting structure which is surmounted by a deck, and at least one layer of air or water impermeable membrane, thermal insulation, usually in plank form, and generally a ballast layer. These types of roofs tend to be economical and function quite well as long as there is no break in the water-impermeable membrane.

In the assembly of such roofs, the fastening of the roofing insulation materials to the roof decks provides a source of several problems. Frequently, mechanical fasteners fashioned from metals are readily conductive to cold or heat and this results in condensation on the fasteners over a period of time leading to the deposition of water on the interior of the building.

By far the most egregious problem associated with mechanical fasteners is the fact that they tend to work out (back out) of the roof decks after a period of time owing to the movement of the roof assembly due to wind, people walking on the roof, freezing and thawing and the like.

The devices of this invention work very nicely when the old roof structures collapse in view of the fact that the devices of this invention can be covered with a new roof assembly when the roof is reconstructed, and still function as a hold down device and leak detector.

The devices of this invention eliminate thermal bridging, that is, loss of heat through other than lack of insulation, while the devices of the prior art do not have that capability.

THE PRIOR ART

There is a U.S. Pat. No. 4,862,664, which issued on Sep. 5, 1989 to Romine in which there is disclosed a roofing fastener for roof assemblies which is a combination of an upper or head portion and a screw. The upper portion is fashioned from an injection molded cut glass fiber filled nylon composition and includes means adapted for drilling and cutting into insulation material during fastener installation.

Also, the screw is insertable in the upper portion and exits through a lower aperture to enable the screw to extend through the multiple layers of the roof assembly and penetrate the roof decking and hold the entire assembly to the decking. However, this combination suffers from the problem that the screw is subject to the problems of the prior art in that without some means of holding the screw in place, the screw eventually works out (backs out) of the penetration.

The leak detection device of U.S. Pat. No. 4,723,109, which issued on Feb. 2, 1988 to Sheahan, shows the hold down device that has been modified in this invention with the unique anti-back out device.

The present invention overcomes the problems of the devices of the prior art.

THE INVENTION

This invention deals with novel devices which are fasteners for roofs, especially multiple layered roofing assemblies.

More specifically, this invention deals with fasteners for roofing, the fasteners in one embodiment comprising in combination a screw having a head and a threaded shaft having a tip end distal to the head.

There is an upper portion comprising a cap and having integrally joined therewith a hollow shank, wherein the cap has a bottom surface and a top surface, and a center point, the shank projecting generally downwardly from the cap.

The hollow shank has a distal end and a near end, the near end projecting through the top surface of the cap at or near the center point of the cap, and the distal end has a bottom wall in it.

The bottom wall has an aperture through it sufficient in size to accommodate the threaded shaft of the screw, but having the ability of retaining the screw head within the hollow shank.

In addition, there is a compressible coiled spring surrounding the threaded shaft of the screw and adapted to fit and move inside the hollow shank and rest on, and lock on, the bottom wall of the hollow shank.

The head of the screw has a boundary surface contour adapted for coupling engagement with a tool means for rotating the screw in the aperture, however, such an adaptation is not critical to this invention and other means of adjusting the screw can be used.

In a second embodiment, there is a hold down and roof leak detector device for securing multiple layered roof structures and detecting water leaks in a roof which comprises enlarged flanged base in combination with other components. The flanged base comprises a bottom plate having a centered aperture extending therethrough, the bottom plate having at least two additional apertures therethrough and located other than at the center of the base plate. The base plate is integrally attached to and surmounted by a centrally located hub which hub has a center bore extending to the upper surface of the bottom plate.

The hub is capable of receiving and securing a detachable, adjustable, hollow first nesting stem wherein the first nesting stem extends vertically from the hub.

The first nesting stem has the upper edge surmounted by an electrical insulating layer or an electrical insulating material, said layer surmounted by at least two metal electrical contacts, each electrical contact having attached to it, an electrical conducting conduit.

Each of the conduits descends through the hollow of the first nesting stem and exits through an aperture located in the wall of the first nesting stem.

Each electrical conduit connects to and terminates at the conductive lead, each conductive lead being positioned and detachedly fixed in one of the additional apertures of the base plate such that the conductive leads will extend through the aperture and pierce a roof membrane secured to a roof structure.

There is a second hollow nesting stem which is operably associated with the first nesting stem, said second nesting stem having an enlarged flanged top mounted on the upper end, said enlarged flanged top comprising a top plate containing a centrally located bore, said top plate having at least two apertures therethrough and located other than at the center of the top plate.

The top plate is integrally attached to and surmounted on a centrally located hub, which hub has a center bore through it, said hub being capable of receiving and detachedly securing the second nesting stem at the end opposite its contact with the first nesting stem.

The enlarged flange top plate contains a tightening plug, surmounted by a tightening protrusion removably located in its central bore.

The tightening plug has removably mounted on its under surface a first compression spring, the first compression spring having a total length approximating the length of the second nesting stem and the first compression spring has mounted on its edge, distal from its attachment to the tightening plug, an electrical insulating layer of an electrical insulating material, said layer surmounted by at least two metal electrical point contacts, each electrical point contact having attached thereto, an electrical conducting conduit, each said conduit ascending through the hollow of the second nesting stem and exiting through an aperture located in the wall of the second nesting stem.

Each electrical conduit connects to and terminates at its own conductive lead, each conductive lead being positioned and detachedly fixed in one of the additional apertures of the top such that the conductive leads are exposed to the atmosphere.

The first nesting stem and second nesting stem are adjustable relative to one another such that when the enlarged flanged base is secured to a multiple layered roof structure, the point contacts of the second nesting stem and the semi-circular contacts of the fist nesting stem are capable of intimately contacting each other. The improvement of the device described just supra, comprises providing a spring loaded fastener for said hold down and roof leak detector device. The spring loaded fastener comprises in combination a screw having an enlarged head and a threaded shaft. The second component is a compressible coiled spring surrounding the threaded shaft of the screw and adapted to fit and move inside the hollow of the first nesting stem and rest on the bottom plate of the enlarged flanged base. The head of the screw has a boundary surface contour adapted for coupling engagement with a tool means for rotating said screw.

BRIEF DESCRIPTION OF THE DRAWINGS

FIG. 7 is a side view of a hold down and leak detector device of this invention without the electrical wires and the like.

FIG. 8 is a cross-sectional side view of the device of FIG. 7, through the lines 200—200 of FIG. 7 but containing the required wiring and the like.

DETAILED DESCRIPTION OF THE INVENTION

Figure 1:
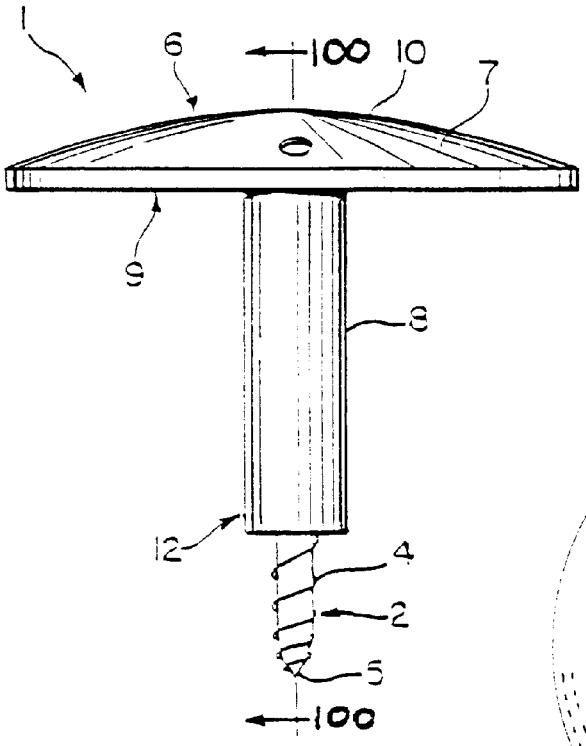
FIG. 1 is a full side view of a fastener combination of this invention.
Figure 6:
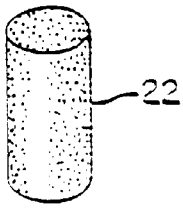
FIG. 6 is a full side view of a compressible foam plug of this invention.
Figure 2:
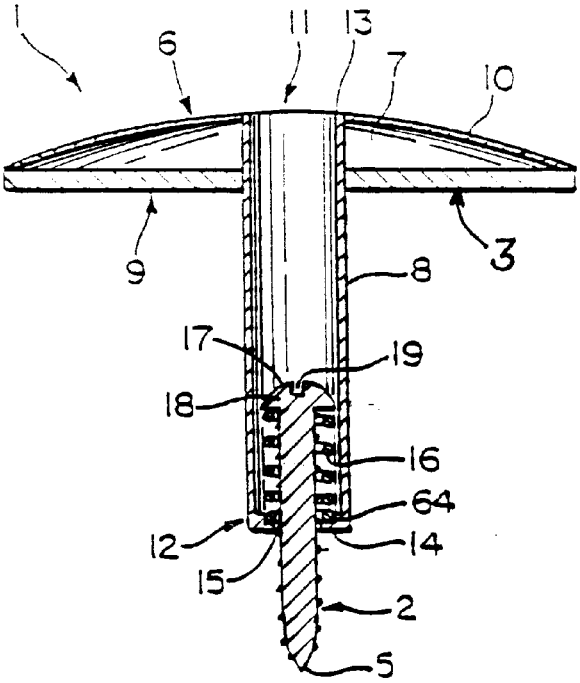
FIG. 2 is a cross sectional side view of the fastener combination of FIG. 1 through the line 100—100.

With reference to FIG. 1 which is a full side view of a fastener combination of this invention and FIG. 2, which is a cross sectional view of a fastener combination 1 of this invention there is shown therein the screw 2, having a head 3, and a threaded shaft 4, which has a tip end 5 which is distal to the head 3.

There is an upper portion 6 having a cap 7, and having integrally joined therewith, a hollow shank 8. The cap 7 has a bottom surface 9, containing an indention 64 for trapping the lower end of the spring 16 and holding it, and, a top surface 10, and a center point 11. The hollow shank 8 projects generally downwardly from the cap 7.

The hollow shank 8 has a distal end 12, and a near end 13, wherein the near end 13 projects through the top surface 10 of the cap 7 at or near the center point 11 of the cap 7. The distal end 12 of the hollow shank 8 has a bottom wall 14 located in it.

The bottom wall 14 has an aperture 15 in it which is sufficient in size to accommodate the threaded shaft 4 of the screw 2. The aperture 15 is sufficient in size to allow the shaft 4 to rest in it, but the aperture 15 is sufficiently small so as to retain the head 3 of the screw 2 in it such that the head 3 rests on the bottom wall 14.

There is a compressible coiled spring 16 surrounding the threaded shaft 4 which coiled spring 16 is adapted to fit and move inside the hollow shank 8 and rest on and lock into the bottom wall 14.

The head 3 of the screw 2 has a boundary surface contour 17 adapted for coupling engagement with a tool means for rotating the screw 2, which is represented, for example, by the rounded surface 18 having a notch 19 for a standard screw driver blade.

In use, the coiled spring 16 is slipped over the threaded shaft 4, the coiled spring 16 and the threaded shaft 4 are inserted into the hollow shank 8 through the top of the upper portion 6, the fastener 1 is placed onto the surface of the multiple layered roof and the tool means is inserted into the hollow shaft 8 and into the notch 19. Upon rotation of the screw 2 by the tool means, the screw 2 is driven downwardly into the roof decking and in the process, the coiled spring 16 is compressed. In this compressed stated, the coiled spring 16 creates a back pressure against the screw 2 and holds the screw 2 securely in the roof decking. Upon the event of any unusual stresses to the roof, such as wind, freezing and thawing, or people walking on the roof, the coiled spring 16 maintains a constant pressure on the screw 2 and does not allow the screw 2 to move. This lack of movement prevents wear in the hole around the screw 2 and allows for the screw 2 to stay in place.

Typically, and preferred for this invention is a screw 2 which is self-tapping in metal decking, although, holes can be drilled into the decking and plastic screws 2 can be utilized.

Figure 4:
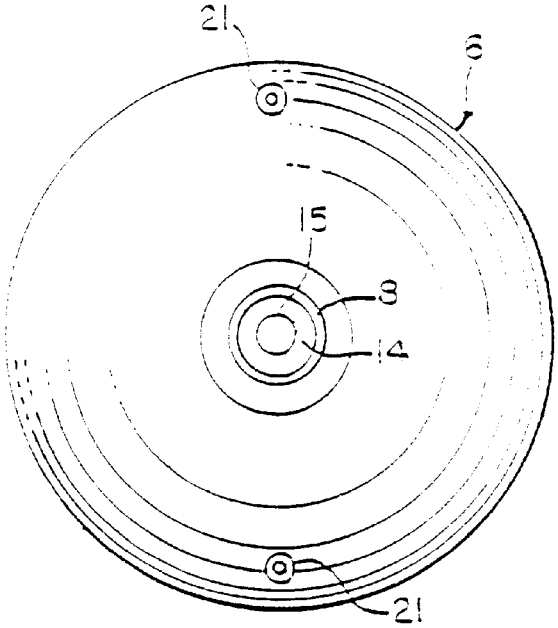
FIG. 4 is a top view of the fastener of FIG. 1.

With reference to FIG. 4, it should be noted by those skilled in the art that there can also be provision made for the cap to have apertures 21 in it to accommodate other fastening devices such as bolts, screws, and nails.

Figure 3:
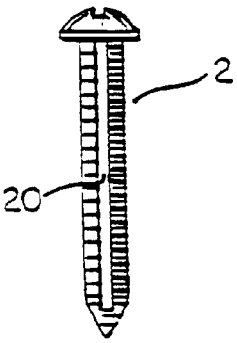
FIG. 3 is a full side view of the screw of the inventive combination.

With reference to FIG. 3, it should be noted by those skilled in the art that the screws 2 of this invention can have at least one opening 20 through the threads and into the shank to help convey water from the top of the fastener to some intermediate layer of the roof, or to the interior of the building for collection and detection purposes.

The continuous opening 20 in the threads should be deep enough that it cuts through the threads and into the shank of the screw 2, because if the continuous opening 20 is not deeper than the threads, the threads will act to cut off both the flow of water downward and the flow of air upward. The continuous opening 20, for purposes of this invention, can be spiral, angular or straight, the precise form of the continuous opening is not critical, as long as it is continuous and deep enough to go through the threads and into the shank and in some cases into the head, and there can be more than one such opening 20.

This invention also contemplates the use in the combination of a compressible plug 22 to fit the hollow shaft 8, after the fastener 1 is in place. The purpose of the plug 22 may be multi-fold, such as thermal insulation to prevent condensation of water on the metal screw or other metal parts, or it may be water proof to prevent the incursion of water into the hollow shank 8.

Figure 5:
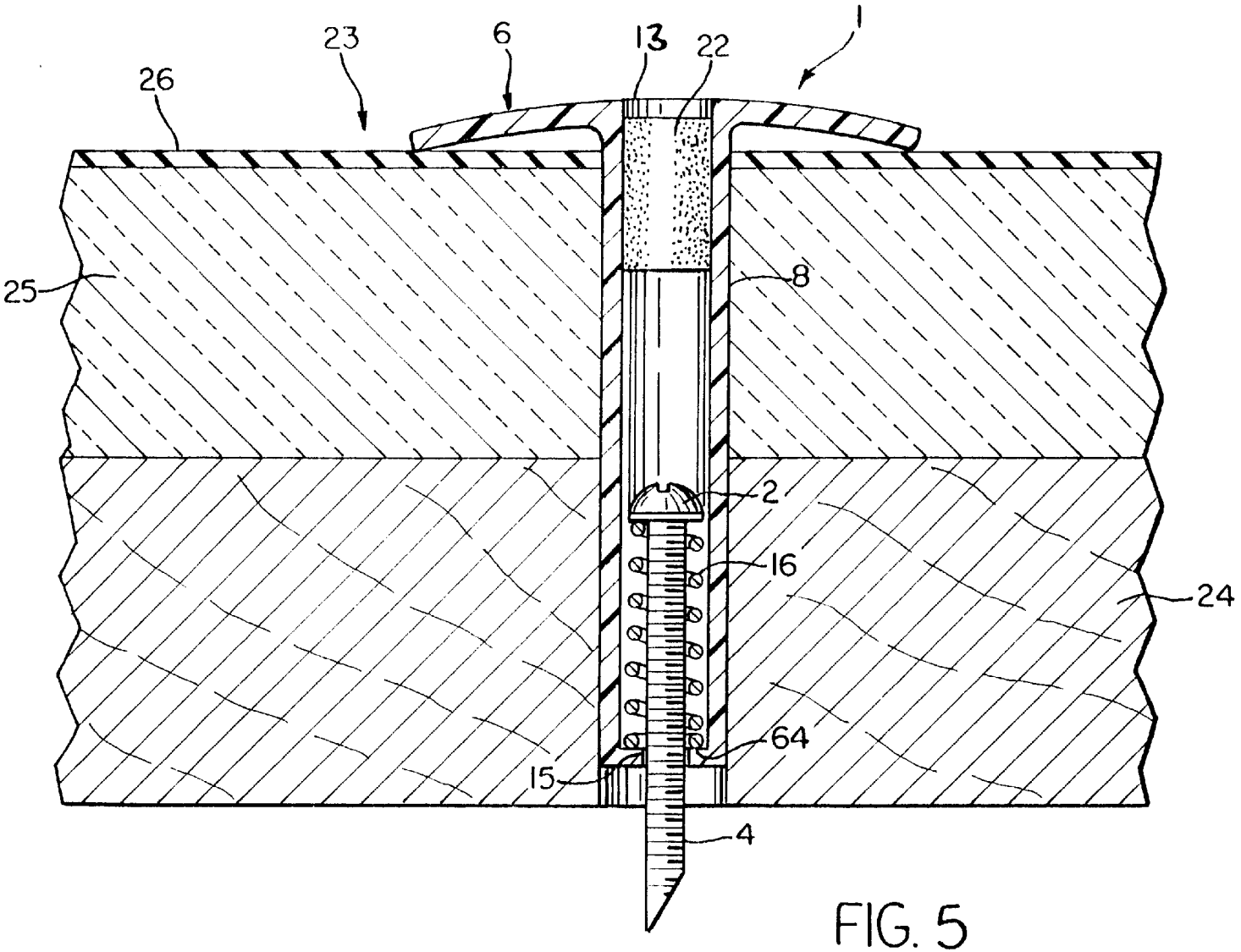
FIG. 5 is a cross sectional view through a multiple layered roof assembly showing the cross sectional side view of the fastener combination of FIG. 2.

Turning now to FIG. 5, there is shown a cross sectional view of a fastener of this invention in place in a multi-layered roof assembly 23.

There is shown the decking layer 24, the insulation layer 25, the rubber sheeting 26, such as EPDM, HYPALON rubber, PVC, CPE modified bitumen, BUR and similar materials, and various elements of the fastener.

Figure 7:
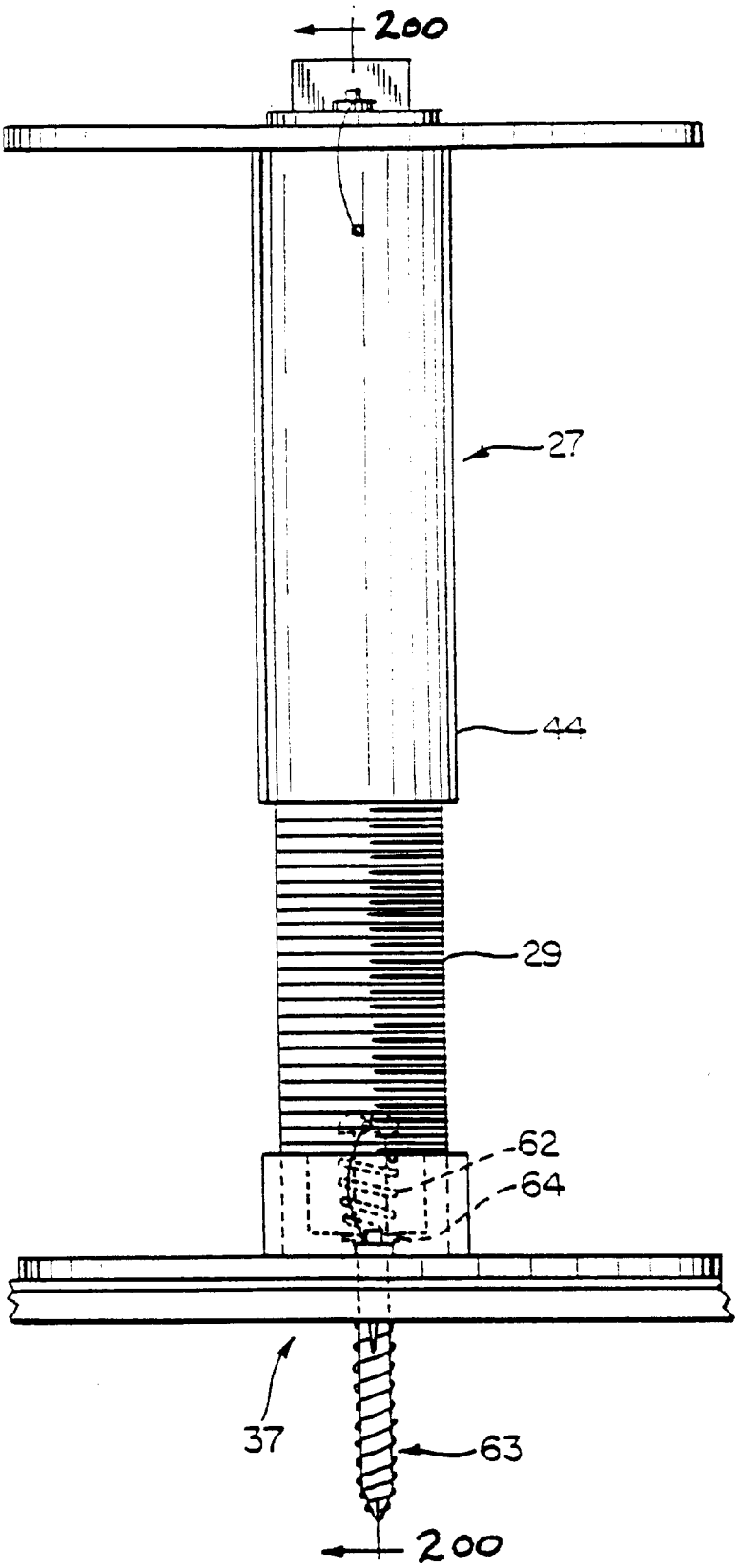
Figure 8:
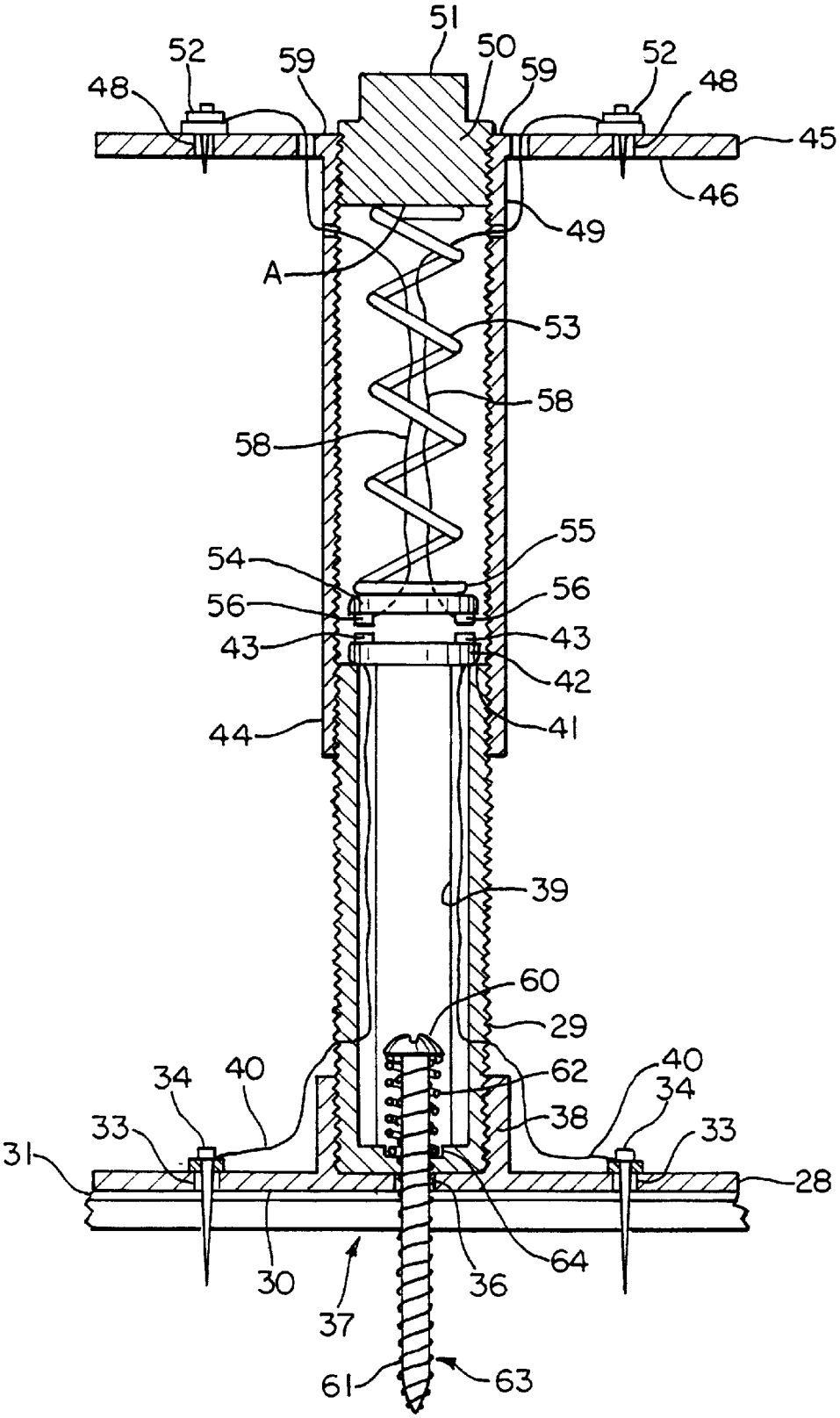

Turning now to the hold down device and leak detector which is another embodiment of this invention, and referring now to FIGS. 7 and 8, in which like numbers indicate like parts or pieces there is shown in FIGS. 7 and 8, a hold down device 27 of this invention which is comprised of an enlarged flanged base 28 and a hollow, first adjustable nesting stem 29 which is shown herein as being threaded. The flange is essentially flat on the bottom 30 which rests on the water-impermeable membrane 31 which in turn covers the roof deck 32 in a roof structure. The flat flange 28 contains two apertures 33 which are receptacles for electrical leads 34, the leads 34 are designed so that they are detachedly secured in the apertures 33 and such that they extend through the apertures 33 and pierce the water-impermeable membrane 31 and roof deck 32, when the device is in place. The flange 28, which can be fabricated from metals, metal alloys or plastics, has a small center bore 36 through which passes a mechanical fastener 37 which mechanical fastener is the improvement for this embodiment of the invention, and which is the principal means by which the device is secured to the roof deck 32. The mechanical fastener 37 is comprised of a screw 63 having a head 60 and a threaded shaft 61. Further, there is a second compressible coiled spring 62 surrounding the threaded shaft 61 of the screw 60. This second compressible coiled spring 62 is adapted to fit and move inside the first nesting hollow stem and rest on the bottom plate 30 of the enlarged flanged base 28.

As can be noted from FIGS. 7 and 8, the enlarged flange base 28 is integrally surmounted by a hub 38 which is internally threaded to receive the hollow, threaded, first nesting stem 29. This hollow nesting stem 29 contains an inner wall 39 which restrains electrical conduits 40 when they are used in the device. The inner wall 39 can be fashioned from plastic or cardboard or any lightweight material as its only function is to restrain the electrical conduits 40.

The uppermost edge 41 of the first nesting stem 28 is surmounted by an electrical insulating layer 42 of an electrical insulating material. The electrical insulated layer 42 is surmounted by at least two metal electrical contacts 43 and each such contact has attached to it an electrical conduit 40, which it will be noted furnishes an electrical connection between the metal leads 34 and the metal contacts 43, the electrical conduits 40 beginning at the electrical leads 34, ascending through the hollow stem of the first nesting stem 29 and terminating at the metal contacts 43.

A second, hollow nesting stem 44 is operably associated with the first nesting stem, in this case by mating threads. The second nesting stem 44 is integrally surmounted by an enlarged flanged top 45, comprising a top plate 46 having a centrally located bore 47 and two apertures 48 therethrough. The top plate 46 has a centrally located hub 49 which has a center bore therethrough to receive and detachedly secure the second nesting stem 44.

The top plate 46 contains in its center bore, a removable tightening plug 50 which has a protrusion 51 extending above the top plate 46 in order that the device can be adjusted up or down by turning the plug 50.

The two apertures 48 have electrical leads 52 removably inserted in them. A first compression spring 53 is removably mounted on the plug 50 at the bottom of the plug at (A). The first compression spring 53 extends through the hollow stem to the end of the second nesting stem 44.

The end of the first compression spring 53 that is distal from its attachment to the plug 50, has an insulating layer 54 of an electrical insulating material attached to the edge 55 thereof. Surmounted on the layer 54, are at least two metal point contacts 56. Attached to each metal point contact 56 is an electrical conduit 58, the electrical conduits 58 ascending through the hollow stem of the second nesting stem 44 and passing through apertures 59 and each connecting to and terminating at the electrical leads 52.

When the first nesting stem 29 and the second nesting stem 44 are joined, the second nesting stem 29 is turned down on the first nesting stem 44 and the metal contacts 43 intimately touch metal contacts 56 thus completing the conduit from metal leads 34 to metal leads 52. The first compression spring 53 ensures that this contact is maintained.

In use, a roof structure is provided with a roof deck and a water impermeable membrane is laid down over the roof deck. The roof deck and membrane can be pre-measured and pre-marked for installation points at which the devices of this invention are secured but it is normal practice to install the roof piecemeal after the water-impermeable membrane is laid down and therefore, the size of the thermal insulation planking or the size of planking on the top most layer will generally determine the installation points of the device since the device is designed to be installed where the four corners of the top planks intersect so that the top plate 46 of the device can grip the corners of the top most planks and hold them down or, the devices can be installed such that the device holds down the center of the top planks.

By whatever procedure desired, the enlarged flange base containing the first nesting stem 29 and the hub 38 integrally secured thereto, is first securely fastened to the roof deck, over top the water-impermeable membrane, using a mechanical fastener 37 as described herein. Such a fastener 37 is inserted through the center bore 36. During this installation, the metal leads 35 pierce the water-impermeable membrane but as soon as the mechanical fastener 37 draws the enlarged flange base 28 tightly to the roof deck, the penetrations made by the leads 35 are sealed by the flange and the water-impermeable membrane remains intact.

Next, the roof is installed except for the ballast layer and as the top planking of the roof is installed, the top half of each device is engaged within the bottom half of each device and the top half is turned down until the top plank of the roof is securely fastened. In the process of turning the top half of the device down, it will be remembered that the metal contacts of the two pieces contact each other. As the top half of the device is turned down to secure the top planks, the first compression spring 53 is compressed in the hollow of the second nesting stem, thereby not requiring any further adjustments in the device to ensure that the contacts are meeting. Finally, the ballast layer is applied to the roof. Rigid thermal planks are often the final layer.

Obviously, the flanges and stems which make up this device, and which contain the electrical accoutrements, are easily prepared in the workshop prior to their use on the roof, although it is possible to prepare them on the job site if it is required.

When prepared in the workshop, the flanges and lower parts of the stems are dipped in curable elastomeric compound to maintain them corrosion and moisture free while in use.

It is contemplated within the scope of this invention to use multiples of the fasteners of this invention in a roof assembly to hold the entire assembly in place, and it is contemplated within the scope of this invention to retrofit roofs that are already in existence and need repair and/or maintenance.

Preferred for this invention are plastic upper portions and metal screws. The preferred metals are aluminum, steel, and iron and the preferred plastics are nylon, polyethylene, polypropylene and the like, especially crosslinked polyethylene. It is contemplated within the scope of this invention to use reinforced and filled plastics.

What is claimed is:

1. A fastener for roofing, the fastener comprising in combination:

a screw having a head, a threaded shaft, and a shank said threaded shaft having a tip end distal to the head thereof; and an upper portion comprising a cap and having integrally joined therewith a hollow shank, said cap having a bottom surface and a top surface, and a center point, said shank projecting generally downwardly from the cap;

said hollow shank having a distal end and a near end, the near end projecting through the top surface of the cap at or near the center point of the cap;

said hollow shank distal end having a bottom wall therein with a top surface;

said bottom wall having an aperture therethrough sufficient in size to accommodate the threaded shaft of the screw therethrough, but retaining the screw head within the hollow shank;

a compressible coiled spring surrounding the threaded shaft of the screw and adapted to fit and move inside the hollow shank and rest on, and lock on, the top surface of the bottom wall of said hollow shank;

the head of the screw having a boundary surface contour adapted for coupling engagement with a tool means for rotating said screw.

2. The fastener as claimed in claim 1 wherein the tip end of the threaded shaft is self-tapping.

3. The fastener as claimed in claim 1 wherein the threaded shaft has at least one opening through the threads and into the shank of the screw, said opening extending continuously from the head through the tip end.

4. The fastener as claimed in claim 1 wherein the threaded shaft has at least one opening through the threads and into the shank of the screw, said opening extending continuously from the tip end to a point short of the head.

5. The fastener as claimed in claim 1 wherein the cap has at least one opening therethrough to accommodate a further fastening device.

6. The fastener as claimed in claim 1 further comprising a compressible plug in the hollow shank.

7. The fastener as claimed in claim 6 wherein the compressible plug is water proof.

8. The fastener as claimed in claim 6 wherein the compressible plug is a thermal insulating material.

9. A roofing assembly utilizing at least one of the fasteners as claimed in claim 1.

10. A roofing assembly utilizing at least one of the fasteners as claimed in claim 2.

11. A roofing assembly utilizing at least one of the fasteners as claimed in claim 3.

12. A roofing assembly utilizing at least one of the fasteners as claimed in claim 4.

13. A roofing assembly utilizing at least one of the fasteners as claimed in claim 5.

14. A roofing assembly utilizing at least one of the fasteners as claimed in claim 6.

15. The fastener as claimed in claim 1 in which the upper portion is metal.

16. The fastener as claimed in claim 1 in which the screw is metal.

17. The fastener as claimed in claim 1 in which the upper portion is plastic.

18. The fastener as claimed in claim 1 in which the screw is plastic.

19. The fastener as claimed in claim 17 wherein the plastic is a reinforced plastic.

20. The fastener as claimed in claim 18 wherein the plastic is a reinforced plastic.

* * * * *